United States Patent [19]

Jaulmes

[11] 4,248,185

[45] Feb. 3, 1981

[54] TWO-CYCLE ENGINE WITH PURE AIR SCAVENGING

[76] Inventor: Eric Jaulmes, 11, Avenue de Bel Air, 75012 Paris, France

[21] Appl. No.: 58,374

[22] Filed: Jul. 17, 1979

[30] Foreign Application Priority Data

Jul. 19, 1978 [FR] France ..... 78 21357

[51] Int. Cl.[3] ..... F02B 33/04

[52] U.S. Cl. ..... 123/73 R; 123/73 CC; 123/73 PP; 123/73 A; 123/73 AF; 123/DIG. 4; 123/65 A

[58] Field of Search ..... 123/65 A, 73 A, 73 R, 123/73 CC, 73 AF, 75 B, DIG. 4, 73 PP

[56] References Cited

U.S. PATENT DOCUMENTS

| | | | |
|---|---|---|---|
| 702,375 | 6/1902 | Nichols | 123/73 CC |
| 976,858 | 11/1910 | Easthope, Jr. | 123/73 CC |
| 1,163,604 | 12/1915 | Raser | 123/73 CC |
| 1,168,425 | 1/1916 | Rosenhagen | 123/73 CC |
| 1,527,166 | 2/1925 | Bezu | 123/73 CC |
| 2,406,491 | 8/1946 | DeWaern | 123/73 CC |
| 2,745,390 | 5/1956 | Heidner et al. | 123/73 R |
| 3,190,271 | 6/1965 | Gudmundsen | 123/29 R |
| 3,363,611 | 1/1968 | Von Seggern et al. | 123/65 A |
| 3,687,118 | 8/1972 | Nomura | 123/73 CC |

*Primary Examiner*—Wendell E. Burns
*Attorney, Agent, or Firm*—Browdy and Neimark

[57] ABSTRACT

A two-cycle internal combustion engine includes a cylinder, a piston in the cylinder and a crankcase pump. The crankcase pump is divided into a first chamber and a second chamber by a membrane. At least one respective transfer passage connects each of the respective chambers to the cylinder. Inlets are provided for admitting pure air into the first chamber and for admitting carbureted air into the second chamber. Devices are provided for opening that one of the transfer passages communicating between the cylinder and the first chamber first and thereafter for opening the one of the transfer passages communicating between said cylinder and said second chamber during operation of the engine.

10 Claims, 9 Drawing Figures

TWO-CYCLE ENGINE WITH PURE AIR SCAVENGING

BACKGROUND OF THE INVENTION

This invention relates to improvements in two-cycle internal combustion engines and, more particularly, to such engines having improved fuel efficiency.

In conventional two-cycle, internal combustion engines, with precompression in the crankcase, scavenging of exhaust gases is generally realized using fresh carbureted air, leading undesirably to high exhaust losses. It is well known that as a result such engines have high fuel comsumption and the presence of unburned hydrocarbons in the exhaust gases.

Numerous techniques and devices have already been proposed and are used to improve conventional two-cycle engines by remedying the above-mentioned drawbacks. The heretofor provided devices generally aim at scavenging the burned gases by pure air and introducing the carbureted air only after scavenging. This is the case, for example, of direct injection engines for which the scavenging air produces an aerodynamic screen across the injector. It has also been proposed to use an auxilliary compressor making it possible to assure scavenging with pure air and to assure producing an aerodynamic screen.

SUMMARY OF THE INVENTION

It is the principal object of the present invention, to provide a two-cycle engine which uses pure air scavenging which is simple in its construction and inexpensive, yet capable of effecting efficient pure air scavenging and providing an aerodynamic screen.

The foregoing object, as well as others which are to become clear from the text below, is achieved in the two-cycle internal combustion engine, of the type which includes a crankcase pump and a cylinder. The crankcase pump is divided into two chambers by a membrane, each of these chambers being connected to the cylinder by a respective at least one transfer passage. Pure air is admitted into one of the chambers while carbureted air is admitted in the other chamber, the transfer passage corresponding to the pure air chamber being made to be open during operation of the engine before the transfer passage corresponding to the carbureted air chamber. Thus scavenging of the exhaust gases is performed with pure air while retaining the simplicity of design of the otherwise conventional two-cycle engine.

Pure air can be admitted into the chamber, which contains the engine crankshaft and the connecting rod, between this crankshaft and a piston, in which case lubrication is achieved by oil brought in separately from the fuel, or carbureted air can be admitted into this chamber, the lubrication being achieved then either as above or with oil mixed with the fuel.

Both the pure air and carbureted air can be distributed in their respective chambers or by an intake valve or by a rotary valve, or by a port opened by the engine piston during its movement.

Preferably, the transfer passages open into the engine cylinder via respective controlled transfer ports. The port operatively associated with the pure air chamber is made to be opened or uncovered by the movement of the piston or in syncronization therewith before the port operatively associated with the carbureted air chamber is opened or uncovered. This in particular makes it possible to assure that the pure air from the corresponding passage forms, in the combustion chamber, an aerodynamic screen between the carbureted air and exhaust orifice. Thus, pure air is allowed to pass into the cylinder first and create an aerodynamic screen across the inlet port for carbureted air, so that when the mixture later enters the cylinder, the exhaust gases will have been scavenged, and the remaining pure air can mix with the mixture supplied to form the correct combustion mixture.

DETAILED DESCRIPTION OF THE PREFERRED EMBODIMENTS

Figure 1:
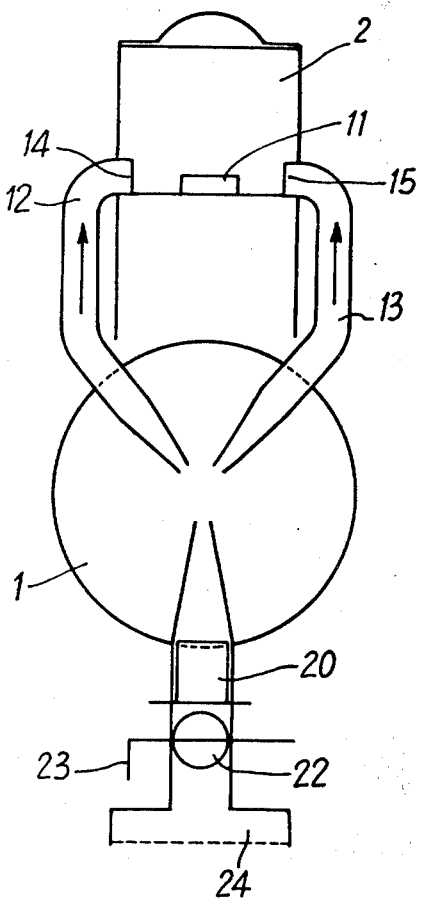
FIG. 1 is a somewhat diagrammatic, elevation view of a first embodiment of a two-cycle, internal combustion engine according to the present invention.
Figure 2:
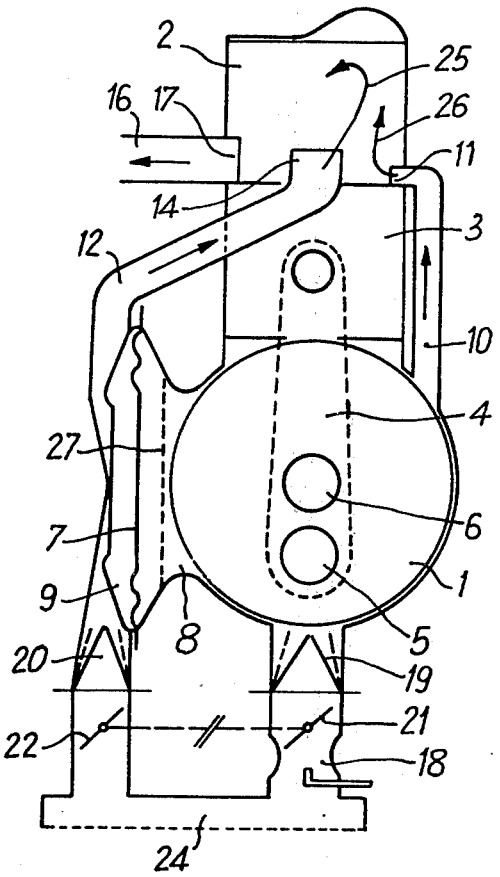
FIG. 2 is a side view of the two-cycle, internal combustion engine of FIG. 1.
Figure 3:
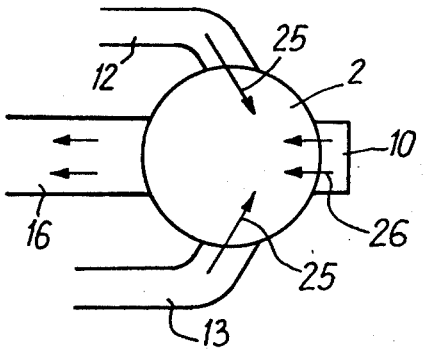
FIG. 3 is a top view of the two-cycle, internal combustion engine of FIGS. 1 and 2.

The two-cycle internal combustion engine represented in FIGS. 1–3 includes a crankcase pump 1 and a cylinder 2 in which piston 3 moves. The piston 3 is driven by a connecting rod 4 having its bearing on a crankpin 5 of a crankshaft 6. The crankcase pump 1 is divided by a membrane 7 into two chambers 8 and 9. The chamber 8, which contains the crankshaft 6 and the connecting rod 4, is connected to the cylinder 2 of the engine by a transfer passage 10 which opens into the cylinder 2 via a port 11. The chamber 9 is connected to the cylinder 2 by two transfer passages 12 and 13 respectively opening into the cylinder 2 via ports 14 and 15. Exhaust is removed via an exhaust passage 16, which is in fluid communication with the cylinder 2 via a port 17. The ports 14 and 15 extend higher in the cylinder 2 than the port 11, so that when the piston 3 descends into the cylinder 2, the ports 14 and 15 are opened before the port 11 is opened. The port 17 extends higher in the cylinder 2 than the ports 14 and 15 so that it is the first of the ports opened.

The chamber 8 is fed carbureted air from a carburetor 18, by a reed valve 19 and the chamber 9 is fed pure air directly by another reed valve 20. Intake valves 21 and 22 respectively control intake of carbureted air and pure air into the chambers 8 and 9. The valves 21 and 22 can be mechanically connected to a throttle 23 or either of the valves can be controlled, in a known manner, by a conventional regulator. Intake into the two chambers 8 and 9 is effected via a conventional air filter 24.

Figure 4:
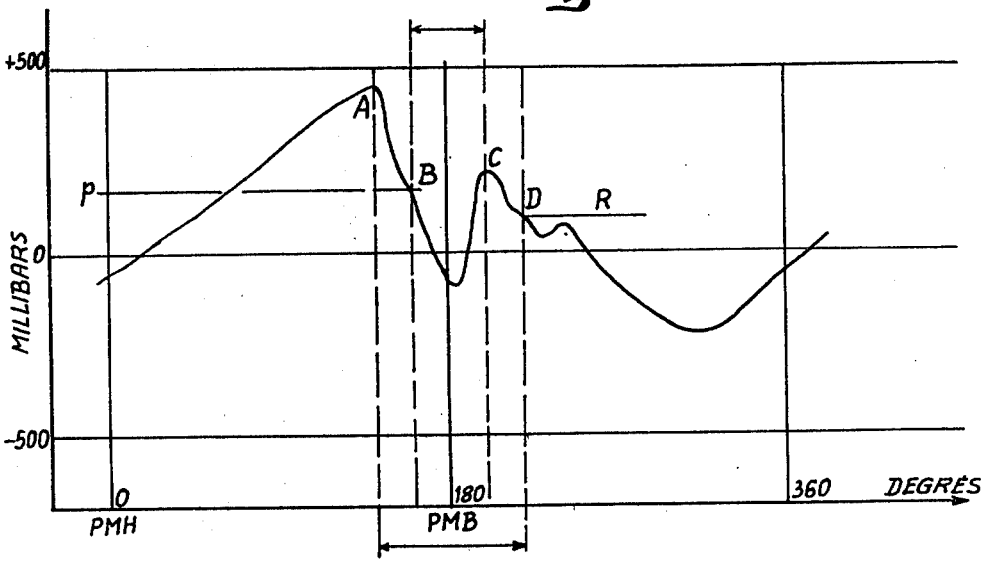
FIG. 4 is a diagram graphically representing the operating sequence of the engine of FIGS. 1 to 3 which aids in understanding the operation thereof.

The operation of the engine illustrated in FIGS. 1–3 is described below, reference being made to FIG. 4 which is a graphic representation of the pressure prevailing in the crankcase pump as a function of the angle of rotation of the crankshaft expressed in degrees. After the top dead center, the pressure increases to point A where the piston by descending uncovers the ports 14 and 15 and consequently opens the passages 12 and 13. The pressure then progressively decreases according to the adiabatic expansion law, while the pure air contained in the chamber 9 goes into the cylinder 2 and scavenges the exhaust gases from the preceding cycle, the exhaust gases and some air flowing out via the port 17 and the exhaust passage 16. At point B, the port 11 in turn is uncovered so that the transfer passage 10 is open. At this moment, a certain fraction of the total volume of the crankcase in the form of pure air flows and the pressure p remains. All the transfers being open, the pressure drops still more rapidly, while the carbureted air contained in the chamber 8 of the crankcase pump passes in turn into the cylinder 2. The port 11 for the carbureted air being placed opposite the cylinder 2 in relation to the exhaust port 17, and the two pure air ports 14 and 15 being directed toward the port 10, the pure scavenging air forms an aerodynamic screen represented in FIGS. 2 and 3 by arrows 25, this screen preventing the flow of carbureted air represented by arrows 26 from escaping through the exhaust conduit 16. When the crankshaft 6 has reached the bottom dead center, a certain amount of oscillations occurs due to exhaust, then the port 11 is covered at point C thus closing the transfer passage 10. The ports 14 and 15 are closed at point D, where a residual pressure R remains, thus closing the transfer passages 12 and 13. The cycle continues by a pressure drop causing the filling of the two chambers 8 and 9 of the crankcase pump 1 to the following top dead center and the operating sequence repeats.

As a result, the scavenging is performed only with pure air coming from the chamber 9, and the carbureted air coming from the chamber 8 is mixed with this pure air. The pure air and carbureted air intake devices are regulated so that after mixture of pure air and carbureted air, the contents of the charge is stoichiometric. Moreover, during rising of the piston, the low pressure condition reaches the crankcase pump 1 rather quickly and causes the chamber 8 to be filled. The carburetor should therefore show a greater pressure drop than that caused by the presence of membrane 7 and the pure air intake valve 20. The pressure is then established on both sides of the membrane 7. A protective grill 27 can, moreover, be provided to limit the travel of the membrane 7. Finally, it can be provided that the pressure drop in the carbureted air intake circuit is of the same order of magnitude as the pressure drop in the pure air intake circuit, taking into account the inertia of the membrane 7.

It has been found that for a given engine speed and load, the amount of residual gases in the cylinder 2 and the amount of pure scavenging air in this cylinder 2 is known; it is, therefore, possible to determine the richness of the carbureted air to obtain a correct combustion point. If the speed and load vary, a connection between the pure air and carbureted air controls makes it possible to obtain other correct combustion points. For a wide range of operations, one of the openings must be corrected as a function of the speed.

Figure 5:
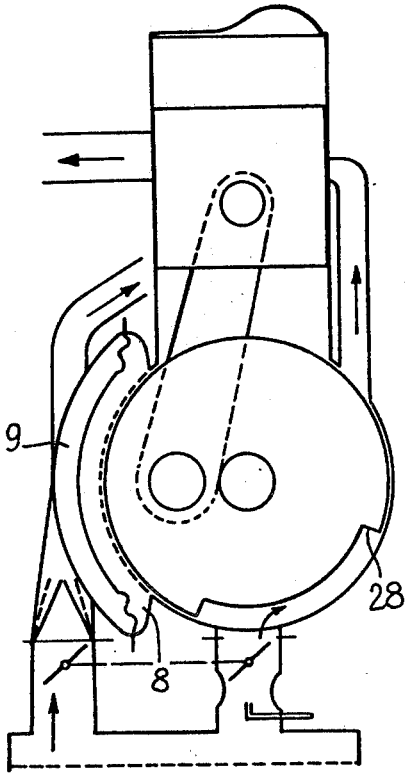
FIG. 5 is a somewhat diagrammatic, side view of a second embodiment of a two-cycle, internal combustion engine according to the present invention.

FIG. 5 represents a similar engine in which the carbureted air intake in the chamber 8 is controlled by a rotary valve 28 instead of by the reed valve 19. Further, the chamber 9 is curved which makes a more compact engine possible. Its functioning is substantially identical with that described above.

Figure 6:
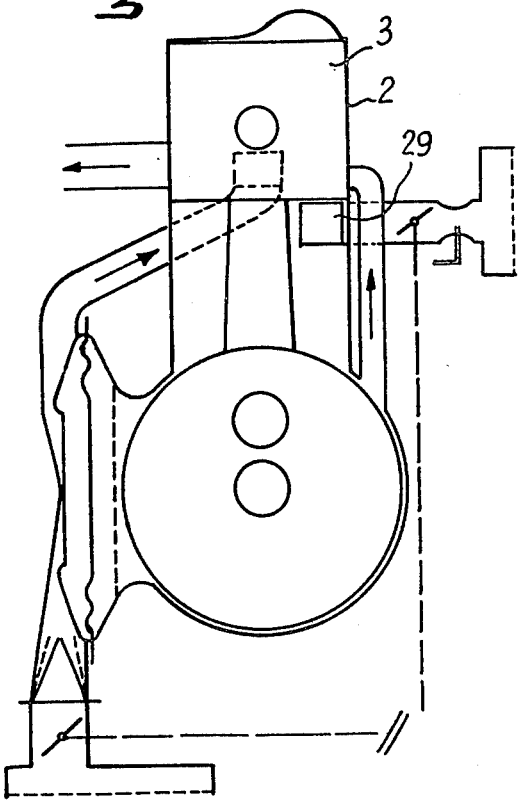
FIG. 6 is a somewhat diagrammatic, side view of a third embodiment of a two-cycle, internal combustion engine in accordance with the present invention.

FIG. 6 represents a variant in which the carbureted air intake is achieved by a port 29 located at the base of cylinder 2 so that this port 29 is open by movement of the piston 3 during its ascent in the cylinder 2. Here again, the functioning is in essence substantially identical with that of the preceding engines.

The two variants of intake modes represented respectively in FIGS. 5 and 6 for the carbureted air could also be applied to the pure air intake control in the chamber 9.

Figure 7:
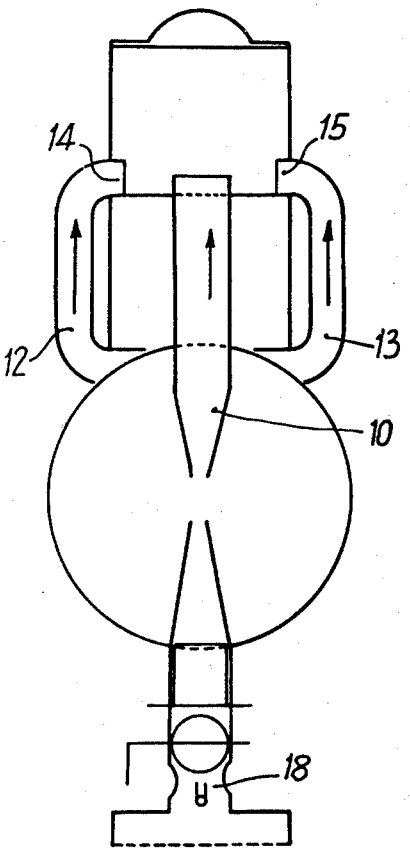
FIG. 7 is a somewhat diagrammatic, elevation view of a fourth embodiment of a two-cycle, internal combustion engine in accordance with the present invention.
Figure 8:
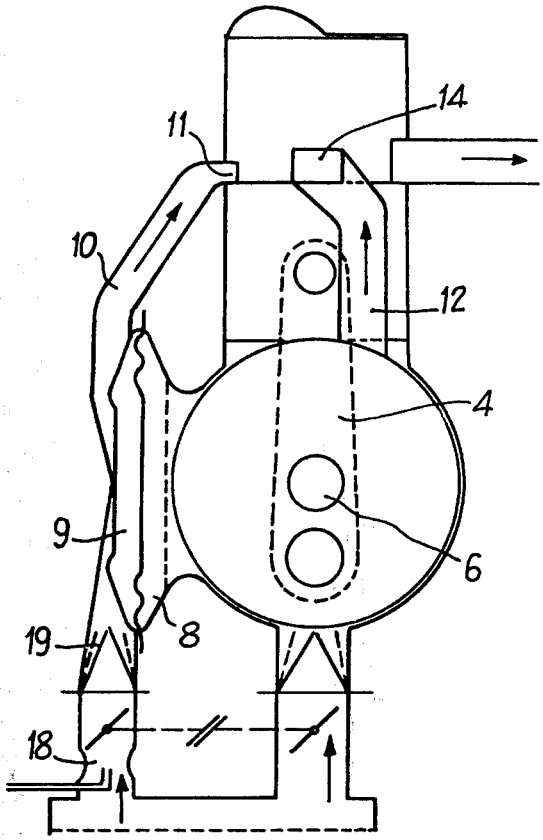
FIG. 8 is a side view of the two-cycle, internal combustion engine of FIG. 7.
Figure 9:
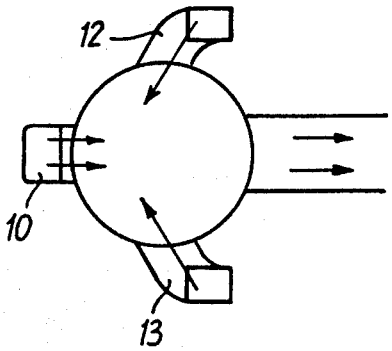
FIG. 9 is a top view of the two-cycle, internal combustion engine of FIGS. 7 and 8.

In the embodiment represented in FIGS. 7–9, the carbureted air is taken into the chamber 9 by the carburetor 18 and the reed valve 19 instead of being admitted into the chamber 8. In this case, the pure air is taken into the chamber 8, the two transfer passages 12 and 13 then extending from this chamber, while the transfer passage 10 extends from the chamber 9. The carbureted air no longer going through the chamber 8 which contains the crankshaft 6 and connecting the rod 4, it is then necessary to provide separate lubrication.

As in the preceding cases, the ports 14 and 15 of the transfer passages 12 and 13 extending from the chamber 8 are higher than the port 11 of the transfer passage 10 extending from the chamber 9, so that scavenging is performed with pure air coming from the chamber 8. The functioning of this engine is in essence therefore substantially identical with that of the other engines described above.

It is to be understood that the foregoing description and accompanying drawings concern illustrative embodiments which are set out, not by way of limitation, but by way of example. Numerous other embodiments and variants are possible without departing from the spirit and scope of the invention, its scope being defined in the appended claims.

What is claimed is:

1. A two-cycle internal combustion engine, the engine comprising a cylinder; a piston in said cylinder; at least one exhaust ports, at least one carbureted air intake port and at least one pure air inlet port in the cylindrical wall of said cylinder, all of said ports being covered and uncovered by said piston as it moves in said cylinder; a crankcase pump, said crankcase pump being divided into a first chamber and a second chamber by a membrane; at least one first transfer passage connecting said first chamber to said cylinder via said at least one pure air inlet port; at least one second transfer passage connecting said second chamber to said cylinder via said at least one carbureted air inlet port, said at least one pure air inlet port being position in said cylinder wall so as to be uncovered during downward movement of said piston in said cylinder ahead of said at least one carbureted air inlet port; means for admitting pure air into said first chamber; and means for admitting carbureted air into said second chamber, whereby the pure air supplied via said at least one pure air inlet port scavengers exhaust gases during operation of the engine.

2. An engine according to claim 1, wherein said first chamber contains a crankshaft of the engine and a connecting rod between said crankshaft and said piston, and means for supplying oil separately from fuel.

3. An engine according to claim 1, wherein said second chamber into which carbureted air is admitted contains a crankshaft of the engine and a connecting rod, said connecting rod extending between said crankshaft and said piston.

4. An engine according to claim 1, including intake valve means for distributing air into at least one of said chambers.

5. An engine according to claim 4, wherein said valve means comprises at least one rotary valve.

6. An engine according to claim 1, including means for distributing air into at least one of said chambers which includes said piston.

7. An engine according to claim 4, wherein said intake valve means includes two intake valves, one for each of said chambers; and including controls for said two intake valves, said controls being mechanically coupled to a throttle.

8. An engine according to claim 1, including a regulator, a valve controlled by said regulator, said valve communicating with at least one of said chambers whereby air intake thereinto is controlled.

9. An engine according to claim 1, including an air intake filter means, air intake into said chambers being effected via said intake filter means.

10. An engine according to claim 1, wherein said at least one said pure air inlet port and said at least one carbureted air inlet port are positioned so that pure air forms, in a combustion chamber defined by said cylinder and said piston, an aerodynamic screen between the carbureted air and said exhaust port formed in said cylinder.

* * * * *